United States Patent [19]

Hegemann et al.

[11] 4,427,183

[45] Jan. 24, 1984

[54] GAS CONTROL SYSTEM FOR STEEL-MAKING CONVERTERS

[76] Inventors: Karl-Rudolf Hegemann, Am krausen Bäumchen 1, 4300 Essen-Bergerhausen; Helmut Weissert, Zunftwiese 79, 4630 Bochum-Hiltrop, both of Fed. Rep. of Germany

[21] Appl. No.: 321,071

[22] Filed: Nov. 13, 1981

[51] Int. Cl.[3] ..... C21B 13/00

[52] U.S. Cl. ..... 266/44; 55/85; 55/210; 55/213; 75/60; 266/89; 266/159

[58] Field of Search ..... 75/60; 266/44, 159, 266/89

[56] References Cited

U.S. PATENT DOCUMENTS

| | | | |
|---|---|---|---|
| 3,799,520 | 3/1974 | Hegemann | 266/19 |
| 4,007,025 | 2/1977 | Hegemann | 55/213 |
| 4,052,042 | 10/1977 | Hegemann | 266/89 |
| 4,123,238 | 10/1978 | Hegemann | 55/226 |
| 4,145,193 | 3/1979 | Hegemann | 55/210 |
| 4,152,123 | 5/1979 | Hegemann | 55/85 |
| 4,192,486 | 3/1980 | Ueda | 266/44 |
| 4,214,735 | 7/1980 | Beentjes | 266/89 |
| 4,218,241 | 8/1980 | Hegemann | 75/60 |
| 4,314,694 | 2/1982 | Ueda | 75/60 |

*Primary Examiner*—P. D. Rosenberg

[57] ABSTRACT

A system for evacuating gases from a top blown steel making converter measures any actual value pressure in a chamber between the seal of a closure ring and duct on which this ring is mounted for movement toward and away from the converter mouth, thereby preventing perturbations from affecting the measurements and allowing accurate control of the evacuating blower to balance the rate of evacuation of the gases and the rate evolution therein in the converter at least during a portion of the blow.

4 Claims, 2 Drawing Figures

GAS CONTROL SYSTEM FOR STEEL-MAKING CONVERTERS

FIELD OF THE INVENTION

Our present invention relates to a control system for converters and, more particularly, to a system for controlling evacuation of gasses from the mouth of a steel-making converter and especially of steel-making converters of the top-blown type.

BACKGROUND OF THE INVENTION

The handling of gases in metallurgical equipment is described in one or more of the following U.S. Pat.: Nos. 3,799,520, 4,007,025, 4,055,331, 4,052,042, 4,123,238, 4,145,193, 4,152,123 and 4,218,241, and in commonly assigned applications Ser. No. 198,042 filed Oct. 17, 1981 now U.S. Pat. No. 4,316,727 issued Feb. 23, 1982 and Ser. No. 281,346 filed July 8, 1981 now U.S. Pat. No. 4,375,439 issued Mar. 1, 1983 and in the various publications, patents and other documents referred to or cited in the files thereof.

Generally speaking a blower or other forced-draft unit, e.g. powered by an electric motor, can be provided in communication with a hood opening at the mouth of a furnace and can have, at its downstream or upstream side, various units designed for gas purification and/or recovery of valuable components from the furnace gases before any remainder is discharged into the atmosphere at a temperature and in a composition such that environmental pollution is minimized or is stored.

Cleaing equipment utilized for this purpose can include scrubbers, cyclones, bag and electrostatic filters and various systems which chemically or by physical processes remove toxic, noxious or other undesirable components from the gas stream or recover particulates therefrom.

Reference will also be made herein to a top-blown converter, i.e. a converter which has a mouth which can be upwardly opened in an upright position of the converter and into which a lance or the like can be inserted to blow oxygen into and onto a charge within the converter in, for example, the refining of pig iron and/or scrap into steel. Such converters are described as to their structure, operation and chemistry, for example at pages 486 ff. of *The Making, Shaping and Treating of Steel,* United States Steel Company, Pittsburgh, Pa. (1971).

In the operation of a top-blown converter for the oxygen refining of steel, when the converter is rotated into its upright position, a hood can be lowered over the converter mouth an communicates via ducts running from the hood with a blower and a cleaning installation of the aforedescribed type for removal of dust from the converter gases and for converter gas storage or discharge.

This hood can comprise, at its lower end, a vertically shiftable closure ring which can form a part which is raised from or lowered toward the rim of the converter surrounding the mouth thereof, this ring being connected by an annular seal with the remainder of the hood, i.e. an upper portion thereof, the seal defining an annular chamber communicating with but separated from the gas passage by this upper portion of the hood and advantageously located outwardly thereof.

The passage communicates via the ducts previously mentioned with a blower and the blower can be provided, in turn, with a controller which regulates the rate at which gases are evacuated from the region of the converter mouth by the blower.

In conventional practice, the gas pressure in the duct is measured and serves as an actual value parameter to operate the controller.

Generally speaking this measuring device or the pressure-measuring location is located well downstream of the mouth of the converter and the hood, e.g. generally in a portion of the duct which can be considered the converter stack, so that the measurement is unaffected by perturbations characteristic of activity at the mouth of the converter. It will be appreciated that the region of the converter mouth is a location at which extremely high turbulence is found, spattering from the charge can occur and a wide variety of disturbances can develop.

In the past, opting for stability of measurement, the field has confined the pressure measurement to a stack region at which reasonably uniform gas flow without such perturbations could be expected.

However, the gas flow through this region includes not only primary gases, i.e. actually evolved from the converter, e.g. by reaction of oxygen with the melt, but also secondary air, i.e. air which is drawn in by the blower between the mouth of the converter and the closure ring. For the most part, the closure ring never seals hermetically against the mouth of the converter and in many cases fairly large gaps, e.g. up to 100 mm in width, may be present between this ring and the juxtaposed rim of the converter mouth. The gas air influx through this ring can amount to thousands of standard cubic meters per hour and this flow has an effect upon the measured pressure and, or course, on the need for the blower to handle the additional contribution of displaced air.

Obviously this is highly disadvantageous not only because of the disturbance to the control point but also because the air added to the evacuated primary gases can be considered a contaminate for these gases and can reduce the economic value of the stored gas, e.g. by decreasing the heat value hereof by dilution. The volume of gas, which must be stored, can also be increased in this way to an inordinate degree.

OBJECTS OF THE INVENTION

It is the principal object of the present invention to provide a control system for a converter gas removal installation whereby these disadvantages are obviated.

Another object of this invention is to provide a method of controlling the evacuation of gases from a steel making converter of the aforedescribed type such that practically only the primary gas passes through the blower and is available for storage and subsequent treatment.

Another object of this invention is to provide a control device or system whereby the disadvantages of earlier systems are avoided.

SUMMARY OF THE INVENTION

We have found, most surprisingly, that these objects can be achieved in a converter, closure ring seal, hood and blower system of the aforedescribed type when the pressure measurement for the actual value input to the flow controller ar the blower is derived from the aforementioned annular chamber which surrounds or is separated from the flow passage and is defined between the seal and the hood portion forming this passage.

More specifically, the method of the present invention comprises lowering the closure ring toward the converter rim while introducing oxygen into the converter and generating primary gases therein, at least in part by decarbonization of the charge by blowing oxygen or, oxygen-containing gas, e.g. air, into the mouth, conducting the primary gas thus generated through a passage above the ring while sealing the duct forming this passage from the ring with the aid of an annular surrounding the latter duct with the chamber being in part defined between a seal separating this passage from ambient atmosphere, measuring the pressure in this chamber and generating an actual-value signal, evacuating the primary gas from the duct, and controlling with this actual-value signal the evacuation of the gas from the duct such that the evacuation rate is substantially equal to the primary gas evolution rate whereby practically no air flows into the duct past the ring.

In the apparatus of the invention, means can be provided for carrying out each of the aforedescribed steps.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
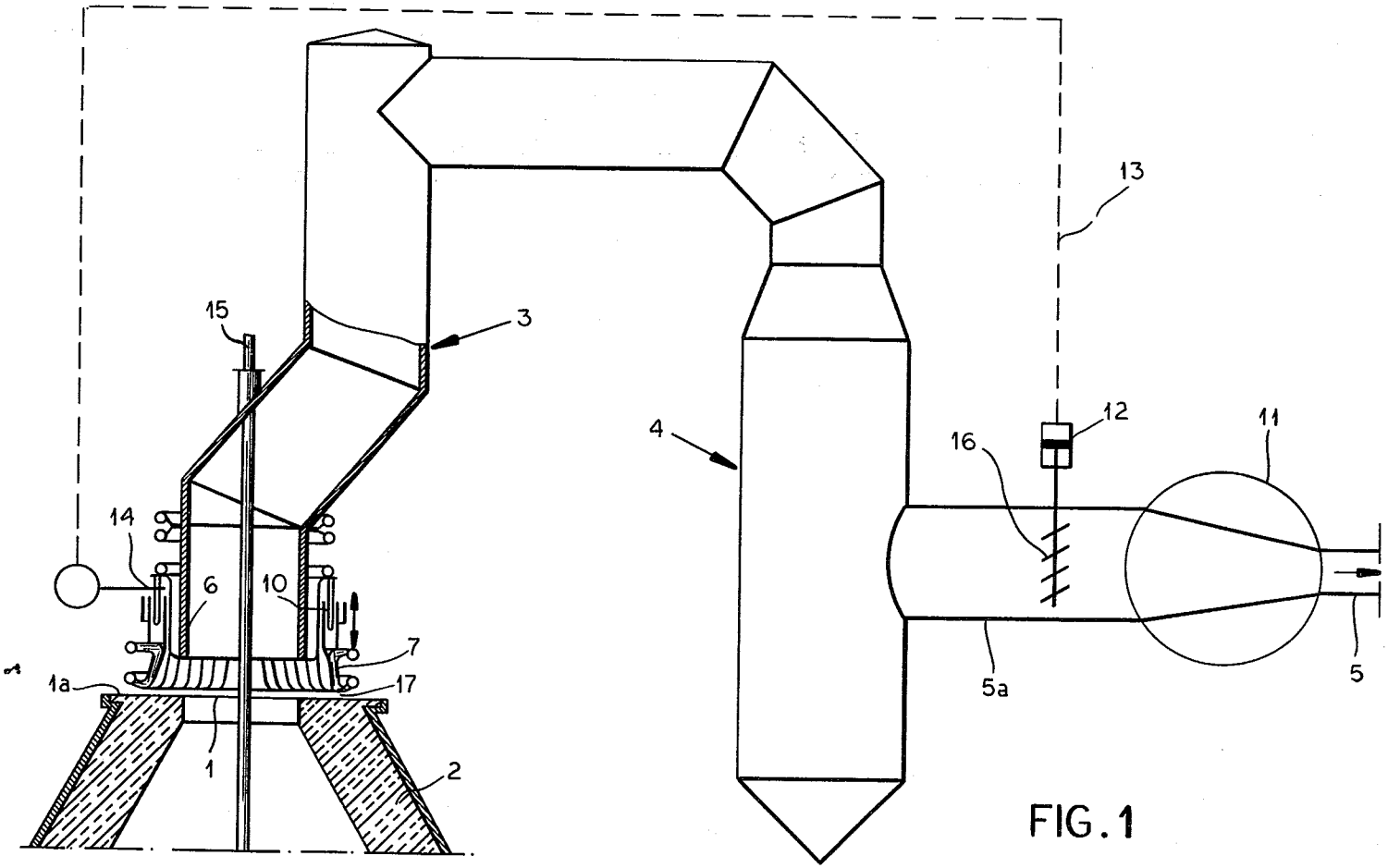
FIG. 1 is a diagrammatic elevational view, partly broken away, of a gas-handling system for a steel-making converter in accordance with this invention.

In FIG. 1 of the drawing we have shown a converter mouth 1 having a rim 1*a* and illustrated with the converter in its upright position preparatory to blowing (see the cited pages of *The Making, Shaping and Treating of Steel,* op.C.T).

The converter 2 cooperates with the converter stack 3 forming a duct which communicates with a dust removal column 4, e.g. a scrubber, and with a duct 5*a* containing a vane control 16 for a blower 11 which feeds the evacuated gas to a duct 5 for storage or further treatment.

The vane control system 16 has been schematically and may represent a plurality of vanes throttling the input to the blower 11 or a device for controlling the speed of the blower or the pitch of its vanes. In other words, the vane control 16 represents any means for controlling the throughput of the blower and hence the rate at which gases will be evacuated thereby.

Figure 2:
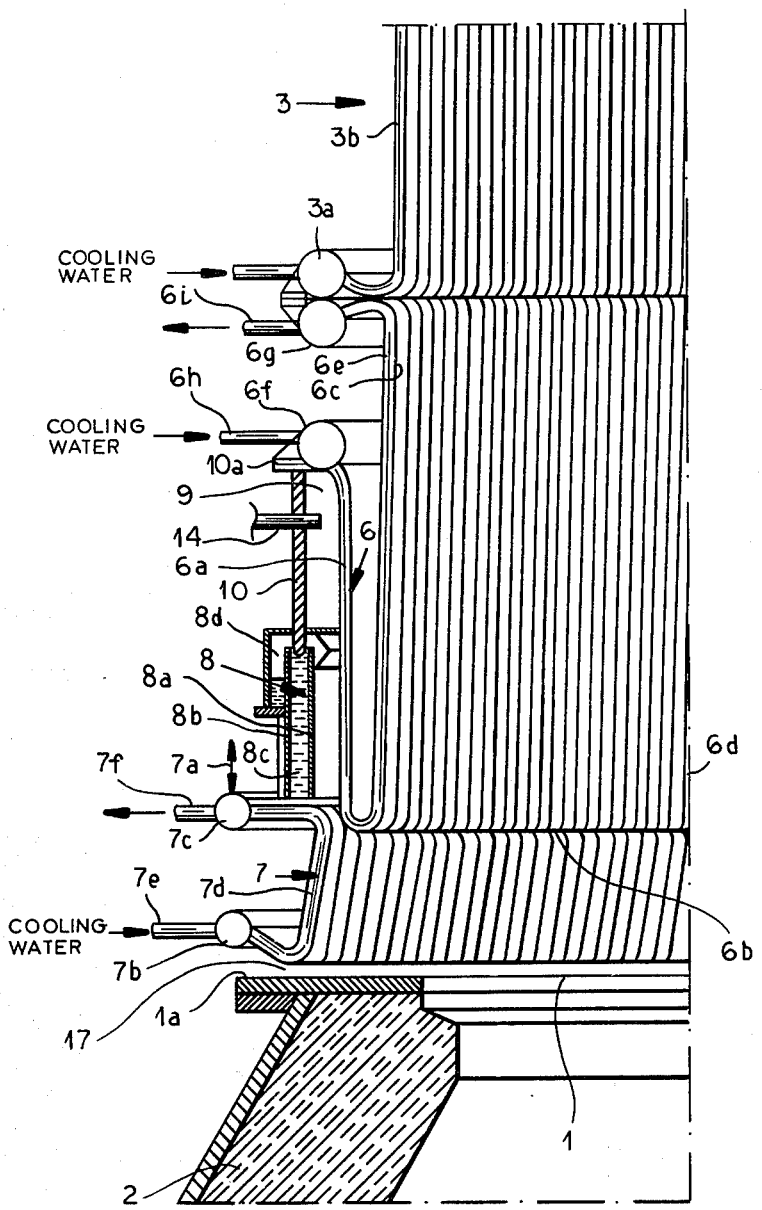
FIG. 2 is a detail view of the region of this system in the vicinity of the converter mouth.

Referring now also to FIG. 2, it can be seen that the stack 3 comprises a gas-collection hood 6, the hood 6 being, in turn, connected to a closure ring 7 via a seal 8. The ring 7 is vertically displaceable as represented by the arrow 7*a* to allow raising and lowering of the ring and hence withdrawal of the ring from the rim 1*a* and approach of the ring to the rim 1*a*, alternatively, the latter position corresponding to a sealing of the converter.

The seal 8 is here formed as a water seal although sand seals and like mobile or labyrinth seals can also be used.

More specifically, a pair of walls 8*a* and 8*b* define between them an upwardly open water pocket 8*c* which is filled with water, any excess overflowing into an annular channel 8*d* surrounding the pocket 8*c*. The downwardly extending annular apron 10 can plunge into this pocket to form a seal with the water thereof which is gastight, this apron being connected at 10*a* to an upwardly and outwardly extending portion 6*a* of the hood 6. Portion 6*a* bends to its lower end 6*b* into the inwardly and upwardly extending stretch 6*c* which defines a flow passage 6*d* for the gases, this passage communicating with the stack 3 and the remainder of the ducts leading to the blower 11.

Between the portion 6*a* and the apron 10, therefore, there is defined an annular chamber 9 which communicates with the passage 6*d* but is outside the main flow of gases and hence also communicates with the interior of the ring 7 and the mouth of the converter.

The ring 7 is water cooled. More particularly, the ring 7 is formed with a pair of manifolds 7*b* and 7*c*, bridged by pipe structure 7*d*, the pipes of the structure 7*d* being welded together to form a continuous annulus. Cooling water is supplied via inlet 7*e* and is discharged by outlet 7*f*.

Similarly, the hood 6 is formed by welded parallel structures of pipe 6*a* which interconnect the manifolds 6*f* and 6*g* supplied with water 6*h* and discharging the cooling water at 6*i*. The stack can also be water cooled as is represented by the fact that manifold 3*a* is provided for the tubes 3*b* of this stack.

The vane control 16 is provided with controller 12 having a control circuit represented mostly diagrammatically by the broken lines 13 and receiving an actual-value signal which regulates the rate at which gas is evacuated by the blower.

Essential to the present invention is the fact that a pressure detector 14 is provided to respond to the pressure in the annular chamber 9 and generate an actual-value signal which is transmitted to the control circuit 13 to operate the vane control 16.

The significance of this invention may best be appreciated by an understanding of the blowing operation.

After the converter is charged with molten pig iron and scrap in the usual manner, it is swung into its upright position for blowing. An oxygen lance 15 is introduced from above and oxygen can be blown onto the charge within the converter. During this period the ring 7 is somewhat removed from the rib 1*a* of the converter and the blower 11 can operate with maximum throughput to draw nonreacted oxygen fom the mouth of the converter.

This continues until ignition occurs within the charge.

The blower 11 for economical reasons is generally dimensioned such that its maximum throughput can correspond only to the maximum gas evolution in the main decarbonization phases at which the gas is ahead of the blower and has a temperature of 70° to 80° C. whereas the gases at the beginning of the blow practically are entirely formed by ambient air at a temperature of 10° to 20° C. The switch-over can be affected by opening the controller 16 so that after first drawing 80% of capacity, the blower draws its maximum.

Upon ignition, i.e. the beginning of reaction of the blown oxygen with the charge, the ring 7 closes automatically against the converter. Gas evolution from the converter remains low during the initial period 6. Certain components of the charge, such as silicon and manganese, have a high affinity for oxygen and are preferentially oxidized.

During this phase, which represents a transition from complete combustion of a carbon monoxide which is formed by the air excess to substoichiometric combustion, it is important to ensure that the gas mixture of carbon monoxide and oxygen lies below the explosive limits.

Theoretically, this does not pose a problem since superstoichiometric supply of air produces a gas consisting of carbon dioxide, oxygen and nitrogen while stoichiometric combustion results only in carbon dioxide and nitrate and substoichiometric reaction yields only carbon dioxide, carbon monoxide and nitrogen, none of these three mixtures being explosive.

In practice, however, with air factors between 1.2 to 0.8, carbon dioxide, carbon monoxide and oxygen can exist together in the gas. To counter the danger of formation of an explosive mixture, the blower is operated for maximum gas throughput during this initial phase of low primary gas evolution and this continues until the ring 7 has moved half of its stroke toward the converter mouth.

Only at this point does the flow control 16 begin to actually regulate the flow and full regulation occurs only when the ring 7 has closed upon the rim of the converter. This mode of operation has the advantage that the air factor range between 1.2 and 0.8 can be exceeded rapidly, i.e. within seconds, and that high gas flow rates generate significant turbulence for optimum mixing and complete reaction of the oxygen.

The controller 16 remains completely closed only as long as the primary gas evolution rate is higher than the operative gas rate. Thereafter, the pressure in chamber 9 operates the control 16 so that a constant pressure prevails in this chamber, signifying that the rate at which the primary gases evolve during the main decarburization step is equal to the rate at which these gases are extracted and hence no significant extraneous air is drawn into the system.

Note that any pressure drop between the pressure in passage **6*d* and the chamber 9 is substantially constant so that the measurement in chamber 9 always reflects the pressure at the duct and at the converter mouth. If the sensor 14 detects an increase in pressure, signifying a higher evolution rate than the evacuation rate, the vane control 16 is opened further and, should the pressure drop in chamber 9** signifying a higher evacuation rate than is necessary, the vane control will close to a corresponding degree to reestablish the set point value of the pressure.

By way of example, when the present invention was applied to a converter having a capacity of 1.40 metric tons, a diameter of the ring 7 of 3.1 meters and a gap width 17 of 100 mm between the converter and the ring, there was practically no flow of external air into the system without pressure measurement in the chamber 9, but utilizing a measurement in the stack 3 a flow of 13,000 $m^3$ (standard temperature and pressure) per hour was detected.

Since the chamber 9 was out of the main gas circulation path, the measurements were unaffected by the perturbations previously mentioned and it was found that this location provided ideal control even for substoichiometric reactions involving extremely low air factors (as little as 0.1).

We claim:

1. A method of operating a gas removal system for a steel-making converter wherein said system includes a converter having a mouth and adapted to receive a charge to be top blown in said converter, a hood forming a passage communicating with said mouth and provided with a closure ring movable toward and away from said mouth, a seal between said ring and said hood defining an annular chamber surrounding said hood and communicating with said passage to a blower connected with said hood for evacuating gases from said converter, said method comprising the steps of:

(a) measuring gas pressure in said chamber;

(b) converting the gas pressure measured in step (a) into an actual-value control signal representing the magnitude of the measured gas pressure; and (c) regulating the rate at which gas is evacuated from said mouth by said blower in accordance with said signal to maintain said ring substantially equal to the rate of evolution of gas in said converter during at least part of the oxygen blowing of a charge therein.

2. In a system for the removal of gas from a converter in the oxygen blowing of a steel making charge thereof, wherein said converter has a mouth, a gas collecting hood is juxtaposed with said mouth and is formed with a passage running to said mouth, a closure ring is disposed between said hood and said mouth and is removable toward and away from said converter, a seal is provided between said ring and said hood, is outwardly off-set from said hood and defines an annular chamber communicating with said passage surrounding said hood, said passage is connected to a blower and means provided for controlling the rate at which gas is evacuated by said blower through said hood, the improvement which comprises:

means for sensing gas pressure in said chamber; and means connecting said sensing means with said controlling means for maintaining the rate at which gas is evacuated from said mouth substantially equal to the rate at which gas is evolved in said converter by the blowing of a charge therein at least during a portion of the period of the blow.

3. The improvement defined in claim 2, further comprising a lance extending inwardly through the mouth of the converter for oxygen blowing a charge therein.

4. The improvement defined in claim 2 or claim 3 wherein said seal includes a water pocket formed on said ring and an apron on said hood extending into said water pocket.

* * * * *